US011122659B2

(12) United States Patent
Xie

(10) Patent No.: US 11,122,659 B2
(45) Date of Patent: Sep. 14, 2021

(54) THREE-WIRE FORWARD AND REVERSE LED LIGHT STRING CONTROL CIRCUIT AND 6-WAY LED LIGHT STRING

(71) Applicant: Huarong Xie, Dongguan (CN)

(72) Inventor: Huarong Xie, Dongguan (CN)

( * ) Notice: Subject to any disclaimer, the term of this patent is extended or adjusted under 35 U.S.C. 154(b) by 0 days.

(21) Appl. No.: 17/012,145

(22) Filed: Sep. 4, 2020

(65) Prior Publication Data

US 2021/0160982 A1 May 27, 2021

(30) Foreign Application Priority Data

Nov. 25, 2019 (CN) ..... 201911166755.8

(51) Int. Cl.

| | |
|---|---|
| ***H05B 45/20*** | (2020.01) |
| ***H05B 45/30*** | (2020.01) |
| ***H05B 45/325*** | (2020.01) |
| ***H05B 45/42*** | (2020.01) |
| ***H05B 45/44*** | (2020.01) |

(52) U.S. Cl.

CPC ..... *H05B 45/325* (2020.01); *H05B 45/20* (2020.01); *H05B 45/42* (2020.01); *H05B 45/44* (2020.01)

(58) Field of Classification Search

CPC ..... H05B 45/20; H05B 45/30; H05B 45/37; H05B 45/325; H05B 45/42; H05B 45/397; H03K 17/22; H03K 17/223; H03K 19/0013

See application file for complete search history.

(56) References Cited

U.S. PATENT DOCUMENTS

| | | | | |
|---|---|---|---|---|
| 5,055,836 | A * | 10/1991 | Kane | H03K 17/6871 340/2.2 |
| 9,130,373 | B2 * | 9/2015 | Testani | G05F 3/04 |
| 2006/0164134 | A1 * | 7/2006 | Uno | H03K 17/22 327/112 |
| 2009/0322252 | A1 * | 12/2009 | Shiu | H05B 45/395 315/297 |
| 2017/0054366 | A1 * | 2/2017 | Ma | G06F 1/266 |

* cited by examiner

*Primary Examiner* — Thai Pham

(74) *Attorney, Agent, or Firm* — Rumit Ranjit Kanakia

(57) ABSTRACT

A three-wire forward and reverse LED light string control circuit, comprising an external power supply, a MCU, a driving circuit and an LED light group circuit, the driving circuit comprises a P-channel first FET, a P-channel third FET, a P-channel fifth FET, a P-channel seventh FET, an N-channel second FET, an N-channel fourth FET, and an N-channel sixth FET; a first port is provided on the wire between the drain of the second FET and the drain of the third FET, a second port is provided on the wire between the drain of the fourth FET and the drain of the fifth FET, and a third port is provided on the wire between the drain of the sixth FET and the drain of the seventh FET. A 6-way LED light string using the said three-wire forward and reverse LED light string control circuit is also provided.

10 Claims, 5 Drawing Sheets

THREE-WIRE FORWARD AND REVERSE LED LIGHT STRING CONTROL CIRCUIT AND 6-WAY LED LIGHT STRING

CROSS REFERENCE TO RELATED APPLICATION

The present application claims priority to China patent application No. 201911166755.8, entitled "THREE-WIRE FORWARD AND REVERSE LED LIGHT STRING CONTROL CIRCUIT", filed on Nov. 25, 2019, the entire content of which is incorporated herein by reference.

TECHNICAL FIELD

The present application relates to the technical field of LED (light-emitting diode) light control, and in particular to a three-wire forward and reverse LED light string control circuit and a 6-way LED light string.

BACKGROUND

Decorative colored light is a decorative light which is connected by multiple light beads in series or in parallel. In the prior art, to realize four-way driving, a five-wire and four-way method is mostly adopted and 5 wires are needed, to realize five-way driving, a six-wire and five-way method is mostly adopted and 6 wires are needed, and 7 wires are needed to realize six-way driving. This circuit has a complex wiring structure, which leads to the high use cost of the LED light string. Moreover, it is difficult for the LED colored lights on the current market to achieve the effect of color conversion of various colored lights by a control circuit, and the light emitting mode is single. Therefore, it is necessary to improve the existing control circuit.

SUMMARY

The purpose of the embodiments of the present application is to provide a three-wire forward and reverse LED light string control circuit, which aims to solve the problems of complex wiring structure and high cost of the LED light string control circuit in the prior art when realizing multi-way driving.

The embodiments of the present application are realized by providing a three-wire forward and reverse LED light string control circuit, comprising an external power supply (VCC), a microcontroller unit (MCU) (U1), a driving circuit and an LED light group circuit, the external power supply (VCC) supplies power to the MCU (U1) and the driving circuit, wherein the driving circuit comprises a P-channel first field effect transistor (FET) (Q1), an N-channel second FET (Q2), a P-channel third FET (Q3), an N-channel fourth FET (Q4), a P-channel fifth FET (Q5), an N-channel sixth FET (Q6) and a P-channel seventh FET (Q7).

Further, the gates of the second FET (Q2), the fourth FET (Q4) and the sixth FET (Q6) are respectively connected to the first output end of the MCU (U1), the second output end of the MCU (U1) and the third output end of the MCU (U1), the sources of the second FET (Q2), the fourth FET (Q4) and the sixth FET (Q6) are grounded respectively, the drain of the second FET (Q2) is connected to the drain of the third FET (Q3), the drain of the fourth FET (Q4) is connected to the drain of the fifth FET (Q5), and the drain of the sixth FET (Q6) is connected to the drain of the seventh FET (Q7); the sources of the third FET (Q3), the fifth FET (Q5) and the seventh FET (Q7) are all connected to the drain of the first FET (Q1), the gates of the third FET (Q3), the fifth FET (Q5) and the seventh FET (Q7) are respectively connected to the fourth output end of the MCU (U1), the fifth output end of the MCU (U1) and the sixth output end of the MCU (U1); the gate of the first FET (Q1) is connected to the PWM (Pulse Width Modulation) control signal output end of the MCU (U1), and the source of the first FET (Q1) is connected to the positive electrode of the external power supply (VCC).

The first port (L1) is provided on the wire between the drain of the second FET (Q2) and the drain of the third FET (Q3), the second port (L2) is provided on the wire between the drain of the fourth FET (Q4) and the drain of the fifth FET (Q5), and the third port (L3) is provided on the wire between the drain of the sixth FET (Q6) and the drain of the seventh FET (Q7), the LED light group circuit is connected to the first port (L1), the second port (L2) and the third port (L3), the LED light group circuit comprises a plurality of light-emitting diodes (LEDs), which are respectively connected in parallel between any two ports of the first port (L1), the second port (L2) and the third port (L3), the two adjacent LEDs arranged between the same two ports have opposite polarity, and the LED light group circuit comprises one selected from the group consisting of an LED light group circuit of 3 ways, an LED light group circuit of 4 ways, an LED light group circuit of 5 ways and an LED light group circuit of 6 ways.

Further, the control circuit further comprises a clock circuit, the clock circuit comprises the first capacitor (C1), the second capacitor (C2) and a crystal oscillator (Y1), two ends of the crystal oscillator (Y1) are respectively connected to two clock ends of the MCU (U1), the first capacitor (C1) is connected between the first end of the crystal oscillator (Y1) and the ground, and the second capacitor (C2) is connected between the second end of the crystal oscillator (Y1) and the ground.

Further, the control circuit further comprises an input circuit for a user to select an operating mode, the input circuit comprises a key switch (S1), a pull-up resistor (R11), a driver chip IR1 and a voltage stabilizing capacitor C3, the key switch (S1) is connected between the input end of the MCU (U1) and the ground, the pull-up resistor (R11) is connected between the positive electrode of the external power supply (VCC) and the VDD pin of the driver chip, and the VSS pin of the driver chip is grounded, the output end of the driver chip (U1) is connected to the input end of the MCU, and the voltage stabilizing capacitor C3 is connected between the VDD pin of the driver chip IR1 and the ground.

Further, the control circuit further comprises a voltage stabilizing capacitor C4, the power supply end of the MCU (U1) is connected to the positive electrode of the external power supply (VCC), the voltage stabilizing capacitor C4 is connected between the positive electrode of the external power supply (VCC) and the ground.

Further, when the LED light group circuit is an LED light group circuit of 3-way, the LED light group circuit comprises the first LED (LED1), the second LED (LED2) and the third LED (LED3), the combination of any two ports of the third LED (LED3) parallel connection is different from that of the first LED (LED1) parallel connection, and is also different from that of the second LED (LED2) parallel connection, wherein when the first LED (LED1) and the second LED (LED2) are connected in parallel between the same two ports, the first LED (LED1) and the second LED (LED2) have opposite polarity.

Further, when the LED light group circuit is an LED light group circuit of 4-way, the LED light group circuit comprises the first LED (LED1), the second LED (LED2), the third LED (LED3) and the fourth LED (LED4), the first LED (LED1) and the second LED (LED2) are connected in parallel between the same two ports, the first LED (LED1) and the second LED (LED2) have opposite polarity, the combinations of any two ports of the third LED (LED3) parallel connection and the fourth LED (LED4) parallel connection are different from the combination of the two ports between which the first LED (LED1) and the second LED (LED2) are connected in parallel, wherein when the third LED (LED3) and the fourth LED (LED4) are connected in parallel between the same two ports, the third LED (LED3) and the fourth LED (LED4) have opposite polarity.

Further, when the LED light group circuit is an LED light group circuit of 5-way, the LED light group circuit comprises the first LED (LED1), the second LED (LED2), the third LED (LED3), the fourth LED (LED4) and the fifth LED (LEDS), the first LED (LED1) and the second LED (LED2) are connected in parallel between the same two ports, the first LED (LED1) and the second LED (LED2) have opposite polarity, the third LED (LED3) and the fourth LED (LED4) are connected in parallel between the same two ports, the third LED (LED3) and the fourth LED (LED4) have opposite polarity, and the combination of any two ports between which the third LED (LED3) and the fourth LED (LED4) are connected in parallel is different from the combination of the two ports between which the first LED (LED1) and the second LED (LED2) are connected in parallel, and is also different from the combination of the two ports of the fifth LED (LEDS) parallel connection.

Further, when the LED light group circuit is an LED light group circuit of 6-way, the LED light group circuit comprises the first LED (LED1), the second LED (LED2), the third LED (LED3), the fourth LED (LED4), the fifth LED (LEDS) and the sixth LED (LED6), the first LED (LED1) and the second LED (LED2) are connected in parallel between the same two ports, the first LED (LED1) and the second LED (LED2) have opposite polarity, the third LED (LED3) and the fourth LED (LED4) are connected in parallel between the same two ports, the third LED (LED3) and the fourth LED (LED4) have opposite polarity, the fifth LED (LEDS) and the sixth LED (LED6) are connected in parallel between the same two ports, the fifth LED (LEDS) and the sixth LED (LED6) have opposite polarity, and the combination of any two ports between which the fifth LED (LEDS) and the sixth LED (LED6) are connected in parallel is different from the combination of the two ports between which the first LED (LED1) and the second LED (LED2) are connected in parallel, and is also different from the combination of the two ports between which the third LED (LED3) and the fourth LED (LED4) are connected in parallel.

Another object of the embodiments of the present application is to provide a 6-way LED light string using the three-wire forward and reverse LED light string control circuit as described above, the LED light group circuit of the LED light string comprises a plurality of RGB light beads, two ways of the 6-way LED light string are used to emit warm white light, and the other four ways are used to emit light of three primary colors, namely red, green and blue, and light of other different colors obtained by different combinations of the three colors of red, green and blue, a program for controlling multiple light-emitting modes is pre-implanted in the MCU (U1), and the 6-way LED light string realizes a forward-reverse jump mode according to the program.

Compared with the prior art, the three-wire forward and reverse LED light string control circuit provided by the present application has the following beneficial effects: the LED light group circuit comprises multiple LEDs, the multiple LEDs are respectively connected in parallel between any two ports of the first port, the second port and the third port, and the two adjacent LEDs located between the same two ports have opposite polarity, so when the MCU outputs different pulse signals, it can control the light-emitting of LED, which makes the LED light string using the present control circuit can not only realize three-way LED light-emitting, but also realize four-way, five-way and six-way LED light-emitting. The wiring structure is simplified, and the manufacturing cost of the light string is reduced. And by pre-implanting a program for controlling multiple light-emitting modes in the MCU, a variety of light-emitting modes can be realized for the RGB light string using the present control circuit, comprising a monochrome static mode, a monochrome flashing mode, a multi-color gradual-change cycling mode and a forward-reverse jump mode.

BRIEF DESCRIPTION OF THE DRAWINGS

In order to more clearly illustrate the technical solutions in the embodiments of the present application or the prior art, drawings used in the description of the embodiments or the prior art will be briefly described below, obviously, the drawings in the following description are only some embodiments of the present application, those of ordinary skill in the art can also obtain other drawings based on these drawings without creative efforts.

DESCRIPTION OF THE EMBODIMENTS

In order to make the technical problems to be solved by the present application, technical solutions and beneficial effects clearer, the present application will be further described in detail below in conjunction with the drawings and embodiments. It should be understood that the specific embodiments described herein are only used to explain the present application, and are not intended to limit the present application.

Figure 1:
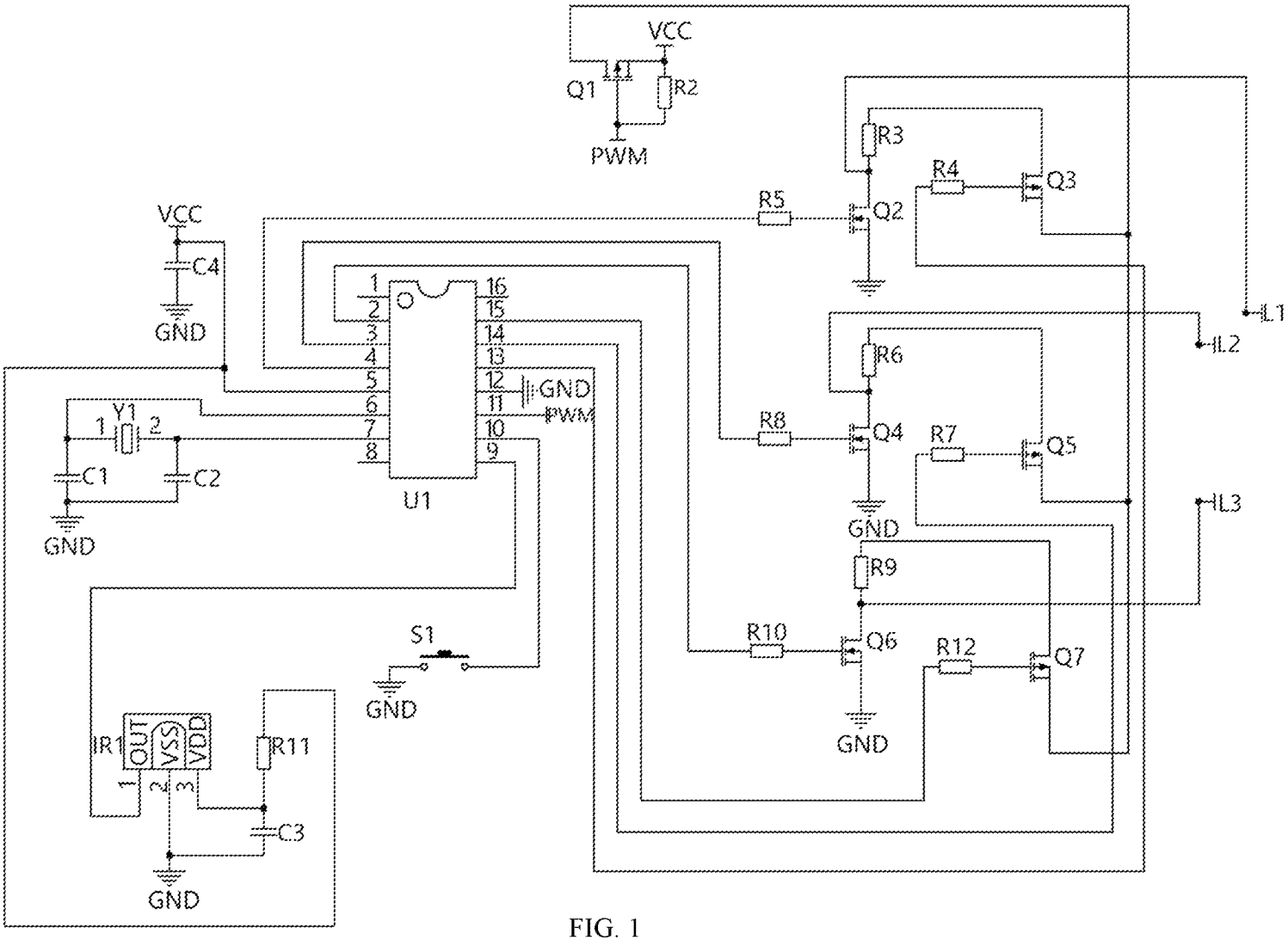
FIG. 1 is a circuit schematic diagram of a three-wire forward and reverse LED light string control circuit provided by the present application.

FIG. 1 is a circuit schematic diagram of a three-wire forward and reverse LED light string control circuit provided by the present application. As shown in FIG. 1, a three-wire forward and reverse LED light string control circuit comprises an external power supply VCC, a microcontroller unit (MCU) U1, a driving circuit and an LED light group circuit, wherein the external power supply VCC supplies power to the MCU U1 through connection with the power supply end of the MCU U1 (i.e., the 5th pin of the MCU U1), the external power supply VCC is also connected with the source of a field effect transistor (FET) Q1 and the PWM (Pulse Width Modulation) control signal output end of the MCU U1 (i.e., the 11th pin of the MCU U1) through a current limiting resistor R2 to supply power for the driving circuit.

In the driving circuit, FETs Q2, Q4 and Q6 are N-channel FETs (NMOS), FETs Q1, Q3, Q5 and Q7 are P-channel FETs (PMOS). The gate of the FET Q2 is connected to the first output end of the MCU U1 (i.e., the 4th pin of the MCU U1) through a current limiting resistor R5, the gate of the FET Q4 is connected to the second output end of the MCU U1 (i.e., the 3rd pin of the MCU U1) through a current limiting resistor R8, and the gate of the FET Q6 is connected to the third output end of the MCU U1 (i.e., the 2nd pin of the MCU U1) through a current limiting resistor R10. The sources of the FETs Q2, Q4 and Q6 are grounded respectively. The drain of the FET Q2 is connected to the drain of the FET Q3 through a current limiting resistor R3, the drain of the FET Q4 is connected to the drain of the FET Q5 through a current limiting resistor R6, and the drain of the FET Q6 is connected to the drain of the FET Q7 through a current limiting resistor R9; the sources of the FETs Q3, Q5 and Q7 are respectively connected to the drain of the FET Q1, the gate of the FET Q3 is connected to the fourth output end of the MCU U1 (i.e., the 13th pin of the MCU U1) through a current limiting resistor R4, the gate of the FET Q5 is connected to the fifth output end of the MCU U1 (i.e., the 14th pin of the MCU U1) through a current limiting resistor R7, and the gate of the FET Q7 is connected to the sixth output end of the MCU U1 (i.e., the 15th pin of the MCU U1) through a current limiting resistor R12; the gate of the FET Q1 is connected to the PWM control signal output end of the MCU U1, the current limiting resistor R2 is connected between the positive electrode of the external power supply VCC and the PWM control signal output end of the MCU U1, and the source of the FET Q1 is connected to the positive electrode of the external power supply VCC. It should be noted here that the current limiting resistors R2, R3, R4, R5, R6, R7, R8, R9, R10 and R12 play a current limiting role, which can be omitted in some embodiments.

Further, a port L1 is provided on the wire between the drain of the FET Q2 and the drain of the FET Q3, a port L2 is provided on the wire between the drain of the FET Q4 and the drain of the FET Q5, and a port L3 is provided on the wire between the drain of the FET Q6 and the drain of the FET Q7. The LED light group circuit is connected to the ports L1, L2 and L3, the LED light group circuit comprises a plurality of light-emitting diodes (LEDs), which are respectively connected in parallel between any two ports of the ports L1, L2 and L3, the two adjacent LEDs arranged between the same two ports have opposite polarity, and the LED light group circuit comprises one selected from the group consisting of an LED light group circuit of 3 ways, an LED light group circuit of 4 ways, an LED light group circuit of 5 ways and an LED light group circuit of 6 ways. The three-wire forward and reverse LED light string control circuit of the embodiment of the present application outputs different pulse signals through the MCU U1, which can realize the control of multi-way LED light string. Compared with the traditional light group, it reduces the main line and the manufacturing cost of the light string, and has a simple circuit structure.

In the three-wire forward and reverse LED light string control circuit provided by the embodiment of the present application, the control circuit further comprises a clock circuit, the clock circuit comprises the first capacitor C1, the second capacitor C2 and a crystal oscillator Y1, two ends of the crystal oscillator Y1 are respectively connected to two clock ends of the MCU U1 (i.e., the 6th and the 7th pins of the MCU U1), the first capacitor C1 is connected between the first end of the crystal oscillator Y1 and the ground, and the second capacitor C2 is connected between the second end of the crystal oscillator Y1 and the ground.

In the three-wire forward and reverse LED light string control circuit provided by the embodiment of the present application, the control circuit further comprises an input circuit for a user to select an operating mode, the input circuit comprises a key switch S1, a pull-up resistor R11, a driver chip IR1 and a voltage stabilizing capacitor C3, the key switch S1 is connected between the 10th pin of the MCU U1 and the ground, the pull-up resistor R11 is connected between the positive electrode of the external power supply VCC and the VDD pin of the driver chip IR1, and the VSS pin of the driver chip IR1 is grounded, the OUT pin of the driver chip IR1 is connected to the 9th pin of the MCU U1, and the voltage stabilizing capacitor C3 is connected between the VDD pin of the driver chip IR1 and the ground.

In the three-wire forward and reverse LED light string control circuit provided by the embodiment of the present application, the control circuit further comprises a voltage stabilizing capacitor C4, which is connected between the positive electrode of the external power supply VCC and the ground.

In specific applications, the external power supply VCC comprises a DC power provided by a battery box and a DC power connected through a USB interface.

The working principle of the three-wire forward and reverse LED light string control circuit of the present application will be further explained in the following specific embodiments.

Figure 2:
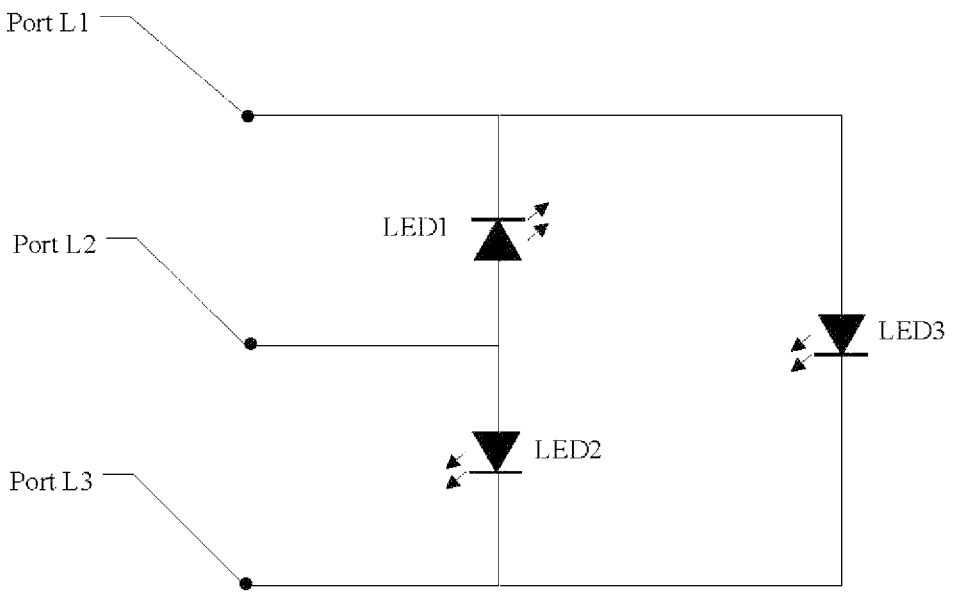
FIG. 2 is a schematic diagram of the first embodiment of an LED light group circuit of 3 ways composed of a three-wire forward and reverse LED light string control circuit provided by the present application.
Figure 3:
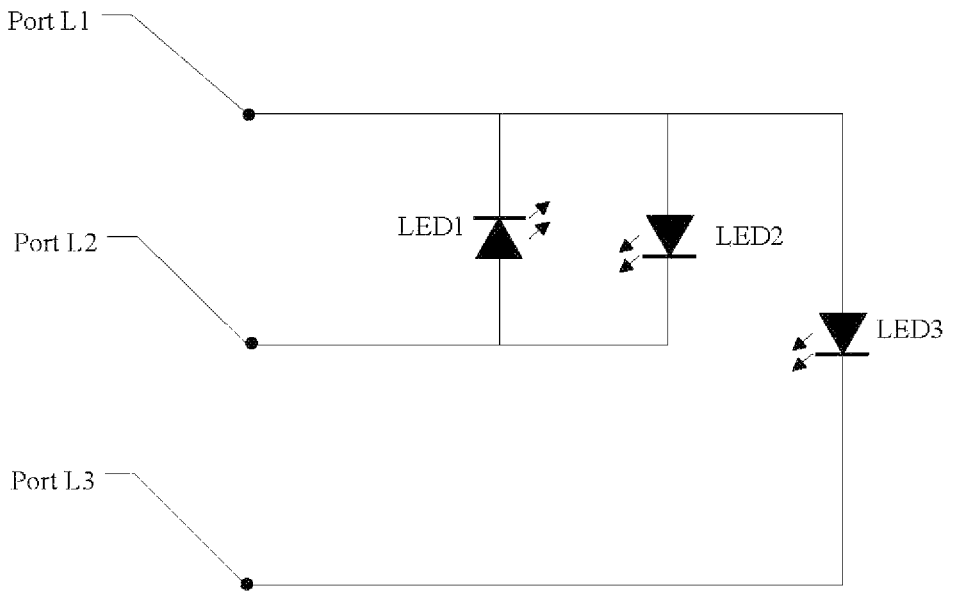
FIG. 3 is a schematic diagram of the second embodiment of an LED light group circuit of 3 ways composed of a three-wire forward and reverse LED light string control circuit provided by the present application.

Referring to FIGS. 2 and 3, FIG. 2 is a schematic diagram of the first embodiment of an LED light group circuit of 3 ways composed of a three-wire forward and reverse LED light string control circuit provided by the present application, and FIG. 3 is a schematic diagram of the second embodiment of an LED light group circuit of 3 ways composed of a three-wire forward and reverse LED light string control circuit provided by the present application. It should be noted that, an LED light group circuit of 3 ways consisting of only three LEDs are used as an example for illustration in the present embodiment, and any other number of LEDs are also within the protection scope of the present application. The case where the LED light group circuit of 3 ways consisting of only three LEDs will be described below.

The LED light group circuit comprises three LEDs, namely the first LED LED1, the second LED LED2 and the third LED LED3. The first LED LED1, the second LED LED2 and the third LED LED3 are respectively connected in parallel between any two ports of the above ports L1, L2 and L3, and the combination of any two ports of the third LED LED3 parallel connection is different from that of the first LED LED1 parallel connection, and is also different from that of the second LED LED2 parallel connection, wherein when the first LED LED1 and the second LED LED2 are connected in parallel between the same two ports, the first LED LED1 and the second LED LED2 have opposite polarity.

Taking an LED light group circuit of 3 ways shown in FIG. 2 as an example, the lighting modes of the LEDs LED1, LED2 and LED3 are as follows: a program for controlling multiple light-emitting modes is pre-implanted in the MCU U1, when the 4th pin of the MCU U1 outputs a low level and the 3rd pin of the MCU U1 outputs a high level, the FET Q2 is turned off and the FET Q4 is turned on, in this case, the port L1 is at a low level and the port L2 is at a high level, so the first LED LED1 lights; when the 3rd pin of the MCU U1 outputs a high level and the 2nd pin of the MCU U1 outputs a low level, the FET Q4 is turned on and the FET Q6 is turned off, in this case, the port L2 is at a high level and the port L3 is at a low level, so the second LED LED2 lights; when the 4th pin of the MCU outputs a high level and the 2nd pin of the MCU outputs a low level, the FET Q2 is turned on and the FET Q6 is turned off, in this case, the port L1 is at a high level and the port L3 is at a low level, so the third LED LED3 lights. The MCU U1 outputs different pulse signals through the 4th pin, the 3rd pin and the 2nd pin thereof, and controls the LEDs LED1, LED2 and LED3 to light individually, two of them light and all light.

The embodiment of the present application also provides a 3-way LED light string using the above three-wire forward and reverse LED light string control circuit, the LED light group circuit of the LED light string comprises a plurality of RGB light beads, which can emit light of three primary colors, namely red, green and blue, and light of other different colors obtained by different combinations of the three colors. For example, when a red LED and a green LED are lit at the same time, red light and green light are mixed to produce yellow light, when a red LED, a green LED and a blue LED are lit at the same time, white light (cold white light) will be generated. And according to the pre-implanted program in the MCU U1 for controlling multiple light-emitting modes, the LED light string has a total of three light-emitting modes under the control of the MCU U1, namely: 1) a monochromatic static mode, that is, constant light; 2) a monochromatic flashing mode, comprising fast flash, slow flash and wavy flash; 3) a multi-color gradual-change cycling mode, that is, red light, green light, blue light and other monochromatic light of different colors cycle in turn. Of course, the user can also select the corresponding light-emitting mode through the key switch S1, for example, each time the switch is pressed, the light-emitting mode will switch to the next one.

Figure 4:
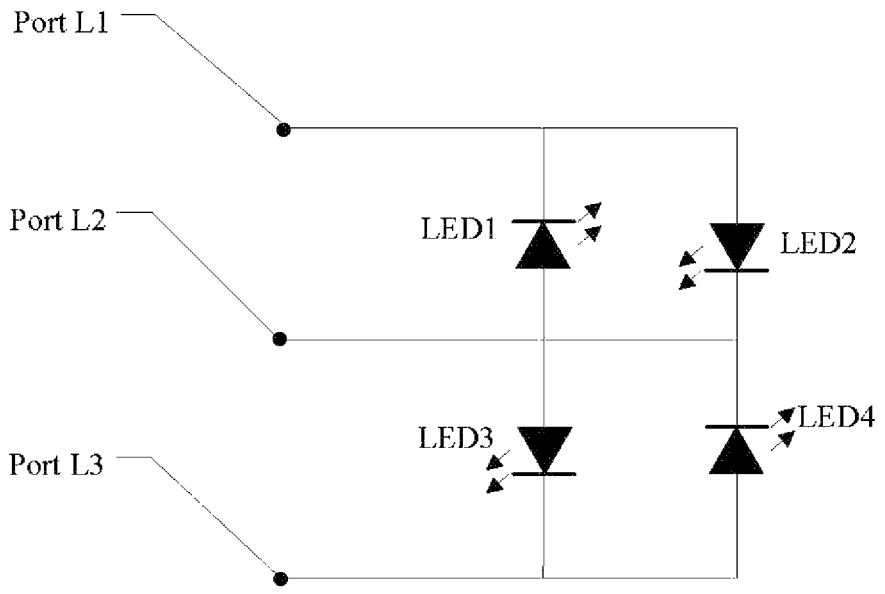
FIG. 4 is a schematic diagram of the first embodiment of an LED light group circuit of 4 ways composed of a three-wire forward and reverse LED light string control circuit provided by the present application.
Figure 5:
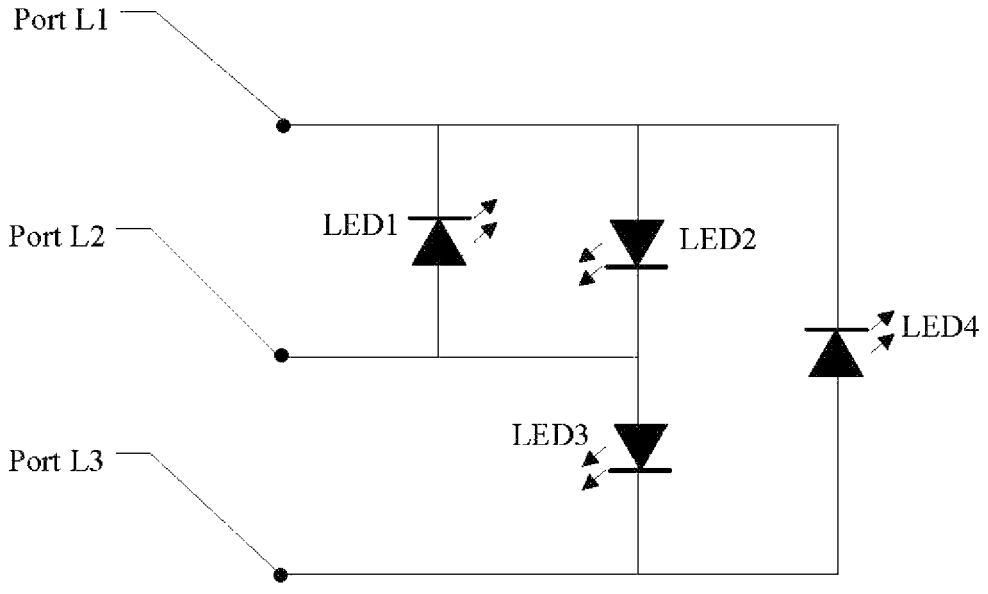
FIG. 5 is a schematic diagram of the second embodiment of an LED light group circuit of 4 ways composed of a three-wire forward and reverse LED light string control circuit provided by the present application.

Referring to FIGS. 4 and 5, FIG. 4 is a schematic diagram of the first embodiment of an LED light group circuit of 4 ways composed of a three-wire forward and reverse LED light string control circuit provided by the present application, and FIG. 5 is a schematic diagram of the second embodiment of an LED light group circuit of 4 ways composed of a three-wire forward and reverse LED light string control circuit provided by the present application. It should be noted that, an LED light group circuit of 4 ways consisting of only four LEDs are used as an example for illustration in the present embodiment, and any other number of LEDs are also within the protection scope of the present application. The case where the LED light group circuit of 4 ways consisting of only four LEDs will be described below.

The LED light group circuit comprises four LEDs, namely the first LED LED1, the second LED LED2, the third LED LED3 and the fourth LED LED4. The first LED LED1, the second LED LED2, the third LED LED3 and the fourth LED LED4 are respectively connected in parallel between any two ports of the above ports L1, L2 and L3, and the first LED LED1 and the second LED LED2 are connected in parallel between the same two ports, the first LED LED1 and the second LED LED2 have opposite polarity, the combinations of any two ports of the third LED LED3 parallel connection and the fourth LED LED4 parallel connection are different from the combination of the two ports between which the first LED LED1 and the second LED LED2 are connected in parallel, wherein when the third LED LED3 and the fourth LED LED4 are connected in parallel between the same two ports, the third LED LED3 and the fourth LED LED4 have opposite polarity.

Taking an LED light group circuit of 4 ways shown in FIG. 4 as an example, the lighting modes of the LEDs LED1, LED2, LED3 and LED4 are as follows: a program for controlling multiple light-emitting modes is pre-implanted in the MCU U1, when the 4th pin of the MCU U1 outputs a low level and the 3rd pin of the MCU U1 outputs a high level, the FET Q2 is turned off and the FET Q4 is turned on, in this case, the port L1 is at a low level and the port L2 is at a high level, so the first LED LED1 lights; when the 4th pin of the MCU U1 outputs a high level and the 3rd pin of the MCU U1 outputs a low level, the FET Q2 is turned on and the FET Q4 is turned off, in this case, the port L1 is at a high level and the port L2 is at a low level, so the second LED LED2 lights; when the 3rd pin of the MCU U1 outputs a high level and the 2nd pin of the MCU U1 outputs a low level, the FET Q4 is turned on and the FET Q6 is turned off, in this case, the port L2 is at a high level and the port L3 is at a low level, so the third LED LED3 lights; when the 3rd pin of the MCU U1 outputs a low level and the 2nd pin of the MCU U1 outputs a high level, the FET Q4 is turned off and the FET Q6 is turned on, in this case, the port L2 is at a low level and the port L3 is at a high level, so the fourth LED LED4 lights. The MCU U1 outputs different pulse signals through the 4th pin, the 3rd pin and the 2nd pin thereof, and controls the LEDs LED1, LED2, LED3 and LED4 to light individually, two of them light, three of them light and all light.

The embodiment of the present application also provides a 4-way LED light string using the above three-wire forward and reverse LED light string control circuit, the LED light group circuit of the LED light string comprises a plurality of RGB light beads, which can emit light of three primary colors, namely red, green and blue, warm white light and light of other different colors obtained by different combinations of the three colors of red, green and blue. And according to the pre-implanted program in the MCU U1 for controlling multiple light-emitting modes, the LED light string has a total of three light-emitting modes under the control of the MCU U1, namely: 1) a monochrome static mode, that is, constant light; 2) a monochrome flashing mode, comprising fast flash, slow flash and wavy flash; 3) a multi-color gradual-change cycling mode, that is, red light, green light, blue light, warm white light and other monochromatic light of different colors cycle in sequence. Of course, the user can also select the corresponding light-emitting mode through the key switch S1, for example, each time the switch is pressed, the light-emitting mode will switch to the next one.

The embodiment of the present application also provides another 4-way LED light string using the above three-wire forward and reverse LED light string control circuit, the LED light group circuit of the LED light string comprises a plurality of RGB light beads, which can emit warm white light and cold white light; in the LED light group circuit of the LED light string, two ways of the 4-way LED light string are used to emit warm white light, and the other two ways are used to emit cold white light. And according to the pre-implanted program in the MCU U1 for controlling multiple light-emitting modes, the LED light string has a total of four light-emitting modes under the control of the MCU U1, namely: 1) a monochrome static mode, that is, constant light; 2) a monochrome flashing mode, comprising fast flash, slow flash and wavy flash; 3) a two-color interchange mode, that is, warm white light and cold white light cycle in sequence; 4) a forward-reverse jump mode, that is, to realize the forward-reverse jump of warm white light and cold white light, and only one of the two adjacent light beads lights and cycles in sequence. Of course, the user can also select the corresponding light-emitting mode through the key switch S1, for example, each time the switch is pressed, the light-emitting mode will switch to the next one.

Figure 6:
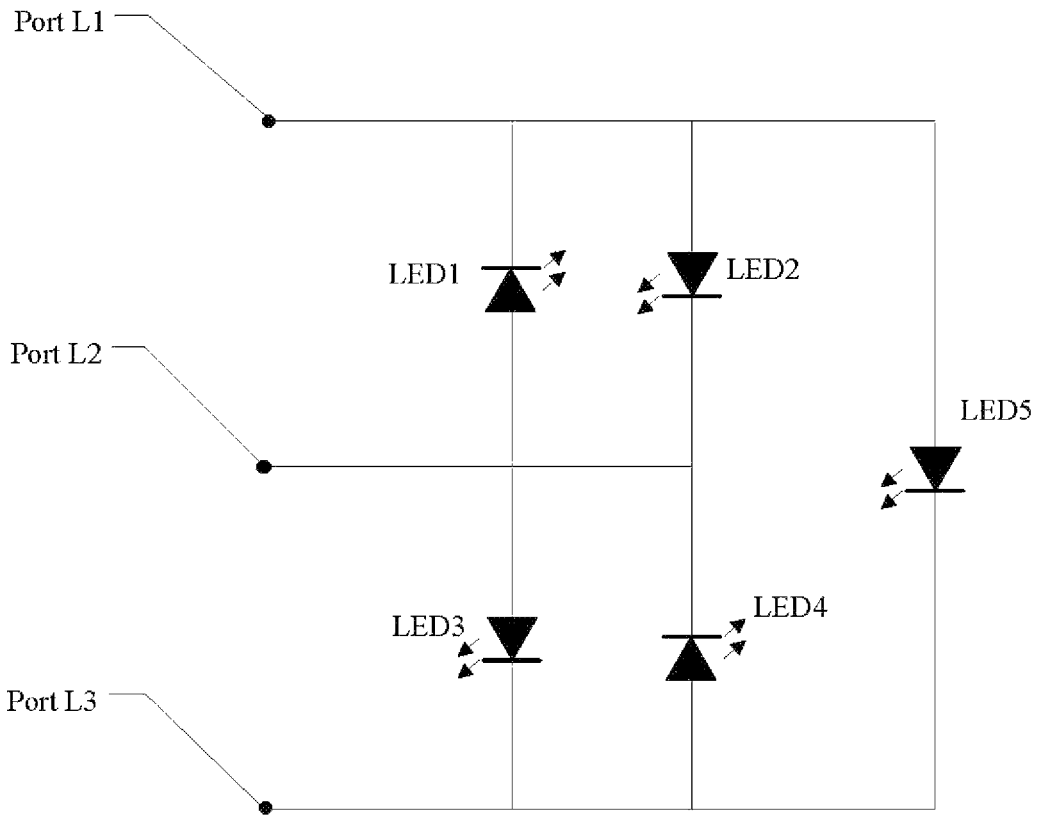
FIG. 6 is a schematic diagram of an embodiment of an LED light group circuit of 5 ways composed of a three-wire forward and reverse LED light string control circuit provided by the present application.

Referring to FIG. 6, FIG. 6 is a schematic diagram of an embodiment of an LED light group circuit of 5 ways composed of a three-wire forward and reverse LED light string control circuit provided by the present application. It should be noted that, in the present embodiment, an LED light group circuit of 5 ways consisting of only five LEDs are used as an example for illustration, and any other number of LEDs are also within the protection scope of the present application. The case where the LED light group circuit of 5 ways consisting of only five LEDs will be described below.

The LED light group circuit comprises 5 LEDs, namely the first LED LED1, the second LED LED2, the third LED LED3, the fourth LED LED4 and the fifth LED LEDS. The first LED LED1, the second LED LED2, the third LED LED3, the fourth LED LED4 and the fifth LED LEDS are respectively connected in parallel between any two ports of the above ports L1, L2 and L3, and the first LED LED1 and the second LED LED2 are connected in parallel between the same two ports, the first LED LED1 and the second LED LED2 have opposite polarity, the third LED LED3 and the fourth LED LED4 are connected in parallel between the same two ports, the third LED LED3 and the fourth LED LED4 have opposite polarity, and the combination of any two ports between which the third LED LED3 and the fourth LED LED4 are connected in parallel is different from the combination of the two ports between which the first LED LED1 and the second LED LED2 are connected in parallel, and is also different from the combination of the two ports of the fifth LED LEDS parallel connection.

FIG. 6 shows an LED light group circuit of 5 ways, the lighting modes of the LEDs LED1, LED2, LED3, LED4 and LEDS are as follows: a program for controlling multiple light-emitting modes is pre-implanted in the MCU U1, when the 4th pin of the MCU U1 outputs a low level and the 3rd pin of the MCU U1 outputs a high level, the FET Q2 is turned off and the FET Q4 is turned on, in this case, the port L1 is at a low level and the port L2 is at a high level, so the first LED LED1 lights; when the 4th pin of the MCU U1 outputs a high level and the 3rd pin of the MCU U1 outputs a low level, the FET Q2 is turned on and the FET Q4 is turned off, in this case, the port L1 is at a high level and the port L2 is at a low level, so the second LED LED2 lights; when the 3rd pin of the MCU U1 outputs a high level and the 2nd pin of the MCU U1 outputs a low level, the FET Q4 is turned on and the FET Q6 is turned off, in this case, the port L2 is at a high level and the port L3 is at a low level, so the third LED LED3 lights; when the 3rd pin of the MCU U1 outputs a low level and the 2nd pin of the MCU U1 outputs a high level, the FET Q4 is turned off and the FET Q6 is turned on, in this case, the port L2 is at a low level and the port L3 is at a high level, so the fourth LED LED4 lights; when the 4th pin of the MCU outputs a high level and the 2nd pin of the MCU outputs a low level, the FET Q2 is turned on and the FET Q6 is turned off, in this case, the port L1 is at a high level and the port L3 is at a low level, so the fifth LED LEDS lights. The MCU U1 outputs different pulse signals through the 4th pin, the 3rd pin and the 2nd pin thereof, and controls the LEDs LED1, LED2, LED3, LED4 and LEDS to light individually, two of them light, three of them light, four of them light and all light.

The embodiment of the present application also provides a 5-way LED light string using the above three-wire forward and reverse LED light string control circuit, the LED light group circuit of the LED light string comprises a plurality of RGB light beads, which can emit light of three primary colors, namely red, green and blue, warm white light and light of other different colors obtained by different combinations of the three colors of red, green and blue. And according to the pre-implanted program in the MCU U1 for controlling multiple light-emitting modes, the LED light string has a total of three light-emitting modes under the control of the MCU U1, namely: 1) a monochrome static mode, that is, constant light; 2) a monochrome flashing mode, comprising fast flash, slow flash and wavy flash; 3) a multi-color gradual-change cycling mode, that is, red light, green light, blue light and other monochromatic light of different colors cycle in turn. Of course, the user can also select the corresponding light-emitting mode through the key switch S1, for example, each time the switch is pressed, the light-emitting mode will switch to the next one.

Figure 7:
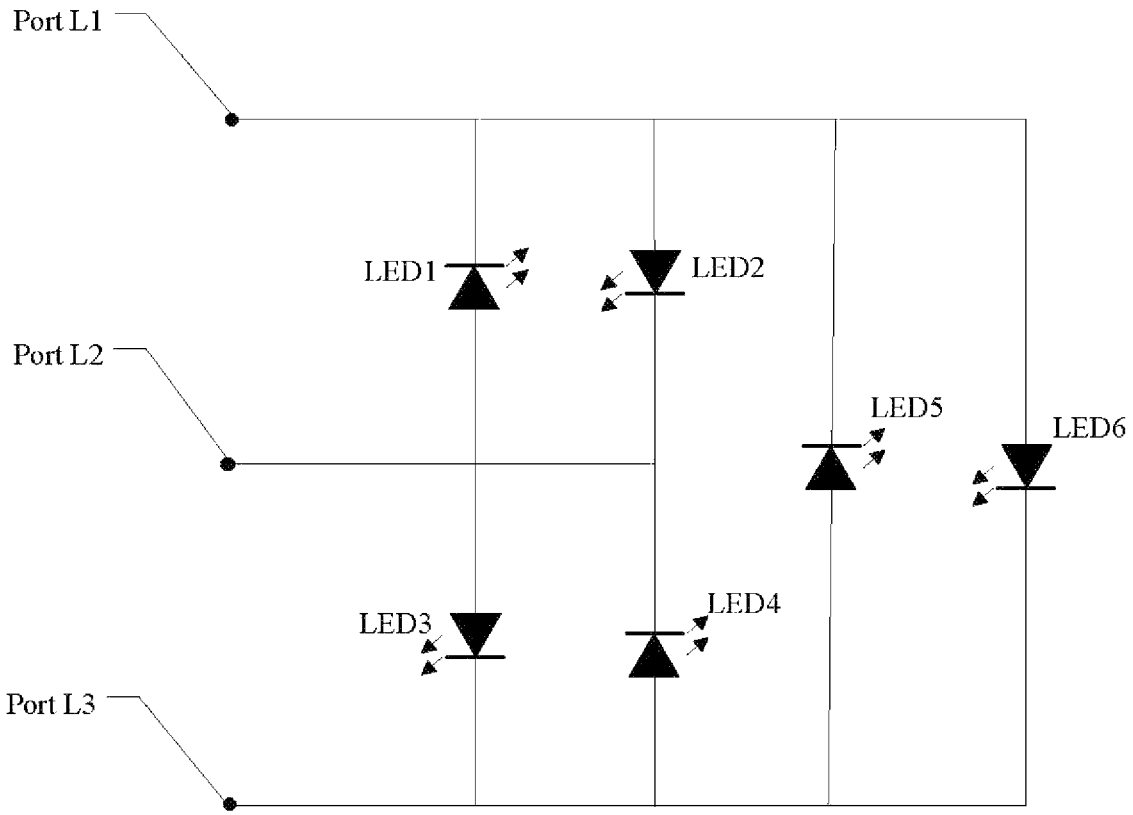
FIG. 7 is a schematic diagram of an embodiment of an LED light group circuit of 6 ways composed of a three-wire forward and reverse LED light string control circuit provided by the present application.

Referring to FIG. 7, FIG. 7 is a schematic diagram of an embodiment of an LED light group circuit of 6 ways composed of a three-wire forward and reverse LED light string control circuit provided by the present application. It should be noted that, in the present embodiment, an LED light group circuit of 6 ways consisting of only six LEDs are used as an example for illustration, and any other number of LEDs are also within the protection scope of the present application. The case where the LED light group circuit of 6 ways consisting of only six LEDs will be described below.

The LED light group circuit comprises 6 LEDs, namely the first LED LED1, the second LED LED2, the third LED LED3, the fourth LED LED4, the fifth LED LEDS and the sixth LED LED6. The first LED LED1, the second LED LED2, the third LED LED3, the fourth LED LED4, the fifth LED LEDS and the sixth LED LED6 are respectively connected in parallel between any two ports of the above ports L1, L2, and L3, and the first LED LED1 and the second LED LED2 are connected in parallel between the same two ports, the first LED LED1 and the second LED LED2 have opposite polarity, the third LED LED3 and the fourth LED LED4 are connected in parallel between the same two ports, the third LED LED3 and the fourth LED LED4 have opposite polarity, the fifth LED LEDS and the sixth LED LED6 are connected in parallel between the same two ports, the fifth LED LEDS and the sixth LED LED6 have opposite polarity, and the combination of any two ports between which the fifth LED LEDS and the sixth LED LED6 are connected in parallel is different from the combination of the two ports between which the first LED LED1 and the second LED LED2 are connected in parallel, and is also different from the combination of the two ports between which the third LED LED3 and the fourth LED LED4 are connected in parallel.

FIG. 7 shows an LED light group circuit of 6 ways, the lighting modes of the LEDs LED1, LED2, LED3, LED4, LEDS and LED6 are as follows: a program for controlling multiple light-emitting modes is pre-implanted in the MCU U1, when the 4th pin of the MCU U1 outputs a low level and the 3rd pin of the MCU U1 outputs a high level, the FET Q2 is turned off and the FET Q4 is turned on, in this case, the port L1 is at a low level and the port L2 is at a high level, so the first LED LED1 lights; when the 4th pin of the MCU U1 outputs a high level and the 3rd pin of the MCU U1 outputs a low level, the FET Q2 is turned on and the FET Q4 is turned off, in this case, the port L1 is at a high level and the port L2 is at a low level, so the second light emitting diode LED2 lights; when the 3rd pin of the MCU U1 outputs a high level and the 2nd pin of the MCU U1 outputs a low level, the FET Q4 is turned on and the FET Q6 is turned off, in this case, the port L2 is at a high level and the port L3 is at a low level, so the third LED LED3 lights; when the 3rd pin of MCU U1 outputs a low level and the 2nd pin of the MCU U1 outputs a high level, the FET Q4 is turned off and the FET Q6 is turned on, in this case, the port L2 is at a low level and the port L3 is at a high level, so the fourth LED LED4 lights; when the 4th pin of the MCU outputs a low level and the 2nd pin of the MCU outputs a high level, the FET Q2 is turned off and the FET Q6 is turned on, in this case, the port L1 is at a low level and the port L3 is at a high level, so the fifth LED LEDS lights; when the 4th pin of the MCU outputs a high level and the 2nd pin of the MCU outputs a low level, the FET Q2 is turned on and the FET Q6 is turned off, in this case, the port L1 is at a high level and the port L3 is at a low level, so the sixth LED LED6 lights. The MCU U1 outputs different pulse signals through the 4th pin, the 3rd pin and the 2nd pin thereof, and controls the LEDs LED1, LED2, LED3, LED4, LEDS and LED6 to light individually, two of them light, three of them light, four of them light, five of them light and all light.

The embodiment of the present application also provides a 6-way LED light string using the above three-wire forward and reverse LED light string control circuit, the LED light group circuit of the LED light string comprises a plurality of RGB light beads, which can emit light of three primary colors, namely red, green and blue, warm white light and light of other different colors obtained by different combinations of the three colors of red, green and blue; in the LED light group circuit of the LED light string, two ways are used to emit warm white light, and the other four ways are used to emit light of three primary colors, namely red, green and blue, and light of other different colors obtained by different combinations of the three colors of red, green and blue. And according to the pre-implanted program in the MCU U1 for controlling multiple light-emitting modes, the LED light string has a total of three light-emitting modes under the control of the MCU U1, namely: 1) a monochrome static mode, that is, constant light; 2) a monochrome flashing mode, comprising fast flash, slow flash and wavy flash; 3) a multi-color gradual-change cycling mode, that is, red light, green light, blue light, warm white light and other monochromatic light of different colors cycle in sequence. Of course, the user can also select the corresponding light-emitting mode through the key switch S1, for example, each time the switch is pressed, the light-emitting mode will switch to the next one.

The embodiment of the present application also provides another 6-way LED light string using the above three-wire forward and reverse LED light string control circuit, the LED light group circuit of the LED light string comprises a plurality of RGB light beads, which can emit warm white light. And according to the pre-implanted program in the MCU U1 for controlling multiple light-emitting modes, the LED light string has a total of three light-emitting modes under the control of the MCU U1, namely: 1) a static mode, that is, constant light; 2) a flashing mode, comprising fast flash, slow flash and wavy flash; 3) a forward-reverse jump mode, that is, only one of the two adjacent light beads lights and cycles in sequence. Of course, the user can also select the corresponding light-emitting mode through the key switch S1, for example, each time the switch is pressed, the light-emitting mode will switch to the next one.

The embodiment of the present application also provides the third 6-way LED light string using the above three-wire forward and reverse LED light string control circuit, the LED light group circuit of the LED light string comprises a plurality of RGB light beads, which can emit light of three primary colors of red, green and blue, and light of other different colors obtained by different combinations of the three colors of red, green and blue. And according to the pre-implanted program in the MCU U1 for controlling multiple light-emitting modes, the LED light string has a total of four light-emitting modes under the control of the MCU U1, namely: 1) a monochrome static mode, that is, constant light; 2) a monochrome flashing mode, comprising fast flash, slow flash and wavy flash; 3) a multi-color gradual-change cycling mode, that is, red light, green light, blue light and other monochromatic light of different colors cycle in sequence; 4) a forward-reverse jump mode, that is, whether a monochromatic light or a mixed polychromatic light is emitted, it can achieve the effect that only one of the two adjacent light beads lights and cycles in sequence. Of course, the user can also select the corresponding light-emitting mode through the key switch S1, for example, each time the switch is pressed, the light-emitting mode will switch to the next one.

The above are only preferred embodiments of the present application and are not intended to limit the present application, any modification, equivalent replacement and improvement made within the spirit and principle of the present application should be included within the protection scope of the present application.

What is claimed is:

1. A three-wire forward and reverse LED light string control circuit, comprising an external power supply, a microcontroller unit (MCU), a driving circuit and an LED light group circuit, wherein the external power supply supplies power to the MCU and the driving circuit, the driving circuit comprises a P-channel first field effect transistor (FET), an N-channel second FET, a P-channel third FET, an N-channel fourth FET, a P-channel fifth FET, an N-channel sixth FET and a P-channel seventh FET;

the second FET, the fourth FET and the sixth FET each has a gate connected to a first output end of the MCU, a second output end of the MCU and a third output end of the MCU respectively, the second FET, the fourth FET and the sixth FET each has a grounded source, the second FET has a drain connected to a drain of the third FET, the fourth FET has a drain connected to a drain of the fifth FET, and the sixth FET has a drain connected to a drain of the seventh FET; the third FET, the fifth FET and the seventh FET each has a source connected to a drain of the first FET simultaneously, the third FET, the fifth FET and the seventh FET each has a gate connected to a fourth output end of the MCU, a fifth output end of the MCU and a sixth output end of the MCU respectively; the first FET has a gate connected to a PWM (Pulse Width Modulation) control signal output end of the MCU, and the first FET has a source connected to the positive electrode of the external power supply.

2. The three-wire forward and reverse LED light string control circuit of claim 1, wherein a first port is provided on a wire between the drain of the second FET and the drain of the third FET, a second port is provided on the wire between the drain of the fourth FET and the drain of the fifth FET, and a third port is provided on the wire between the drain of the sixth FET and the drain of the seventh FET, the LED light group circuit is simultaneously connected to the first port, the second port and the third port, the LED light group circuit comprises a plurality of LEDs, which are connected in parallel among any two ports of the first port, the second port and the third port, and two adjacent LEDs arranged between the same two ports have opposite polarity, and the LED light group circuit is one selected from the group consisting of an LED light group circuit of 3 ways, an LED light group circuit of 4 ways, an LED light group circuit of 5 ways and an LED light group circuit of 6 ways.

3. The three-wire forward and reverse LED light string control circuit of claim 2, wherein the control circuit further comprises a clock circuit, the clock circuit comprises a first capacitor, a second capacitor and a crystal oscillator, both ends of the crystal oscillator are respectively connected to two clock ends of the MCU, the first capacitor is connected between a first end of the crystal oscillator and the ground, and the second capacitor is connected between a second end of the crystal oscillator and the ground.

4. The three-wire forward and reverse LED light string control circuit of claim 2, wherein the control circuit further comprises an input circuit for a user to select an operating mode, the input circuit comprises a key switch, a pull-up resistor, a driver chip and a voltage stabilizing capacitor, the key switch is connected between the input end of the MCU and the ground, the pull-up resistor is connected between the positive electrode of the external power supply and a VDD pin of the driver chip, and the VSS pin of the driver chip is grounded, an output end of the driver chip is connected to the input end of the MCU, and the voltage stabilizing capacitor is connected between the VDD pin of the driver chip and the ground.

5. The three-wire forward and reverse LED light string control circuit of claim 2, wherein the control circuit further comprises a voltage stabilizing capacitor, the power supply end of the MCU is connected to the positive electrode of the external power supply, the voltage stabilizing capacitor is connected between the positive electrode of the external power supply and the ground.

6. The three-wire forward and reverse LED light string control circuit of claim 2, wherein when the LED light group circuit is an LED light group circuit of 3-way, the LED light group circuit comprises a first LED, a second LED and a third LED, the combination of any two ports of the third LED parallel connection is different from that of the first LED parallel connection, and is also different from that of the second LED parallel connection, wherein when the first LED and the second LED are connected in parallel between the same two ports, the first LED and the second LED have opposite polarity.

7. The three-wire forward and reverse LED light string control circuit of claim 2, wherein when the LED light group circuit is an LED light group circuit of 4-way, the LED light group circuit comprises a first LED, a second LED, a third LED and a fourth LED, the first LED and the second LED are connected in parallel between the same two ports, the first LED and the second LED have opposite polarity, the combination of any two ports of the third LED parallel connection and the fourth LED parallel connection is different from the combination of the two ports between which the first LED and the second LED are connected in parallel, wherein when the third LED and the fourth LED are connected in parallel between the same two ports, the third LED and the fourth LED have opposite polarity.

8. The three-wire forward and reverse LED light string control circuit of claim 1, wherein when the LED light group circuit is an LED light group circuit of 5-way, the LED light group circuit comprises a first LED, a second LED, a third LED, a fourth LED and a fifth LED, the first LED and the second LED are connected in parallel between the same two ports, the first LED and the second LED have opposite polarity, the third LED and the fourth LED are connected in parallel between the same two ports, the third LED and the fourth LED have opposite polarity, and the combination of any two ports between which the third LED and the fourth LED are connected in parallel is different from the combination of the two ports between which the first LED and the second LED are connected in parallel, and is also different from the combination of the two ports of the fifth LED parallel connection.

9. The three-wire forward and reverse LED light string control circuit of claim 1, wherein when the LED light group circuit is an LED light group circuit of 6-way, the LED light group circuit comprises a first LED, a second LED, a third LED, a fourth LED, a fifth LED and a sixth LED, the first LED and the second LED are connected in parallel between the same two ports, the first LED and the second LED have opposite polarity, the third LED and the fourth LED are connected in parallel between the same two ports, the third LED and the fourth LED have opposite polarity, the fifth LED and the sixth LED are connected in parallel between the same two ports, the fifth LED and the sixth LED have opposite polarity, and the combination of any two ports between which the fifth LED and the sixth LED are connected in parallel is different from the combination of the two ports between which the first LED and the second LED are connected in parallel, and is also different from the combination of the two ports between which the third LED and the fourth LED are connected in parallel.

10. A 6-way LED light string using the three-wire forward and reverse LED light string control circuit of claim 1, wherein the LED light group circuit of the LED light string comprises a plurality of RGB light beads, the 6-way LED light string has two ways to emit warm white light, and has remaining four ways to emit light of three primary colors consisting of red, green and blue, and light of other different colors obtained by different combinations of the three colors of red, green and blue, a program for controlling multiple light-emitting modes is pre-implanted in the MCU, and the 6-way LED light string realizes a forward-reverse jump mode according to the program.

* * * * *